US008083163B1

(12) United States Patent
Hutchinson

(10) Patent No.: US 8,083,163 B1
(45) Date of Patent: Dec. 27, 2011

(54) DEMOLITION MACHINE METHOD AND APPARATUS FEATURING SHEAR OR PULVERIZER WITH MAGNET

(75) Inventor: Brad Hutchinson, Rushville, OH (US)

(73) Assignee: Company Wrench, Ltd., Carroll, OH (US)

( * ) Notice: Subject to any disclaimer, the term of this patent is extended or adjusted under 35 U.S.C. 154(b) by 0 days.

(21) Appl. No.: 12/846,397

(22) Filed: Jul. 29, 2010

(51) Int. Cl.
*B02C 1/02* (2006.01)

(52) U.S. Cl. ..... 241/30; 241/101.73

(58) Field of Classification Search ..... 241/30, 241/101.72, 101.73, 264, 266
See application file for complete search history.

(56) References Cited

U.S. PATENT DOCUMENTS

| | | | |
|---|---|---|---|
| 4,425,072 | A | 1/1984 | Lewis |
| 4,670,983 | A | 6/1987 | Ramun et al. |
| 5,044,569 | A | 9/1991 | LaBounty et al. |
| 5,060,378 | A | 10/1991 | LaBounty et al. |
| RE35,432 | E | 1/1997 | LaBounty et al. |
| 5,628,611 | A | 5/1997 | Ito et al. |
| 5,704,560 | A | 1/1998 | Wimmer |
| 5,894,666 | A | 4/1999 | Hrusch |
| 5,926,958 | A | 7/1999 | Ramun |
| 5,940,971 | A | 8/1999 | Ramun |
| 6,015,108 | A | 1/2000 | Okumura et al. |
| 6,061,911 | A | 5/2000 | LaBounty et al. |
| 6,119,970 | A | 9/2000 | LaBounty et al. |
| 6,129,298 | A | 10/2000 | Nye |
| 6,202,308 | B1 | 3/2001 | Ramun |
| 6,439,317 | B1 | 8/2002 | Minotti et al. |
| 6,481,949 | B1 | 11/2002 | Cullen |
| 6,839,969 | B2 | 1/2005 | Jacobson et al. |
| 6,926,217 | B1 | 8/2005 | LaBounty et al. |
| 6,994,284 | B1 | 2/2006 | Ramun |
| 7,108,211 | B2 | 9/2006 | Ramun |
| 7,121,489 | B2 | 10/2006 | Ramun |
| 7,216,575 | B2 | 5/2007 | Alseth et al. |
| 7,255,295 | B2 | 8/2007 | Ramun |
| 7,284,330 | B2 | 10/2007 | Wagner |
| 7,284,718 | B2 | 10/2007 | Christenson |
| 7,284,720 | B2 | 10/2007 | Ramun |
| 7,306,177 | B2 | 12/2007 | Ward |
| 7,311,126 | B2 | 12/2007 | Sharp |
| 7,354,010 | B2 | 4/2008 | Ramun et al. |
| 7,407,017 | B2 | 8/2008 | Robson |
| 2007/0001041 | A1 | 1/2007 | Christenson |

FOREIGN PATENT DOCUMENTS

| | | |
|---|---|---|
| WO | WO 01/68992 | 9/2001 |

*Primary Examiner* — Mark Rosenbaum
(74) *Attorney, Agent, or Firm* — Roger A. Gilcrest

(57) ABSTRACT

The present invention is a magnetic lifting attachment to the boom structure and hydraulic system of a demolition machine, which includes a demolition tool selected from the group consisting of shearing jaws and a concrete pulverizer, and a hydraulic actuator adapted to actuate the demolition tool, the magnetic lifting attachment is attached to the boom structure and features a magnet and a hydraulic actuator adapted to move the magnet between a stored position and an active position with respect to the demolition tool by simultaneous movement of at least one of the jaws.

14 Claims, 2 Drawing Sheets

DEMOLITION MACHINE METHOD AND APPARATUS FEATURING SHEAR OR PULVERIZER WITH MAGNET

FIELD OF THE INVENTION

The present invention relates to a hybrid demolition shear and a hybrid concrete pulverizing apparatus and methods of their manufacture and use.

BACKGROUND

In the field of construction demolition, one of the principal measures of performance is the amount of scrap material that can be moved from a demolition site within a given period of time. Several factors affect this work rate.

One factor is the ability of demolition equipment to shear or pulverize the scrap metal material as efficiently as possible. Generally, it is most advantageous to use a shearing tool or pulverizer head whose operation is not interrupted by required equipment or accessory changes.

As an example of devices of the prior art, U.S. Pat. No. 4,670,983 simply provides for a mounting aperture from which a magnet might be removably hung and then removed, as needed. However, operating systems like these typically require that a magnetic lifting unit be stored or placed separate from the demolition machine, and installed in a discrete operation while the demolition tool is taken temporarily out of service. The magnetic lifting unit must then be connected to a source of power and then operated in a discrete operation in which already sheared material is moved from the position where it has been sheared into pieces or pulverized to yield smaller metal or metal-bearing pieces for removal from the demolition site.

Another factor is access and mobility within a demolition site that is typically a complex landscape of constantly changing and disorganized piles of material. It is most beneficial to be able to create and negotiate paths through the material. This requires demolition equipment to be as mobile as possible to be able to navigate the downed building material, and to be able to move and remove waste from the demolition site.

Another aspect of demolition site operation is the need to have demolition equipment that can maintain continuous operation to demolish, pick, place and remove waste material following shearing and/or pulverizing of the demolition target structure, without requiring the operator to interrupt operations to dismantle and reassemble or reconfigure the demolition machine for respective shearing and/or pulverizing steps and subsequent picking, placement and removal steps, in sequence, such as would be the case in the operation of a shearing head arm that is adapted to be used as a support for a magnet that must be hung and removed for magnetic pick, place and removal functions following shearing (as described in U.S. Pat. No. 4,670,983, hereby incorporated herein by reference). Such a device requires the operator to cease shearing operations, position the arm to accept a hung magnetic lifter, and leave the cab of the vehicle to hang the magnetic lifter and attach its power source. The operation must then be reversed following use of the magnetic lifter, in order to reinitiate shearing operations.

Such an arrangement also has the disadvantage of lacking articulation and the degrees of freedom typically associated with hydraulic arm linkages, as U.S. Pat. No. 4,670,983 calls only for the magnet to be hung from the hydraulic arm by a chain of other flexible support.

In addition, a demolition site does not lend itself to the temporary dismantling and/or storage of large portions of a demolition machine. Accordingly, it is advantageous to provide demolition equipment that can operate within limited space while being able to demolish, pick, place and remove waste material following shearing and/or pulverizing of the demolition target structure.

It is therefore beneficial to be able to provide demolition equipment that can continuously operate through discrete sequences of respective shearing and/or pulverizing steps and subsequent picking, placement and removal steps, without the need to reconfigure, reassemble or re-mount respective tool heads or the like.

Other arrangements in the prior art provide permanent magnets incorporated into boom arms, such as those described in U.S. Pat. Nos. 5,628,611 and 6,015,108, also hereby incorporated herein by reference. However, these references do not allow the advantage of readily moving the magnet into an effective position where the shearing occurs and metal scrap is released, without interference from portions of the shearing or pulverizing tool.

Accordingly, there remains a need for demolition equipment and methods able to address the concomitant problems of the need for high performance cutting and pulverizing tools within a complex and variable demolition site landscape, to be able to increase the efficiency in demolition site clean-up in terms of the amount of scrap material that can be processed and removed from a demolition site per unit time, as well as to provide lower operational costs.

In this regard, there also remains a need for combination shearing and magnetic lifting tools that more effectively allow the operator to alternatively deploy and store both the shearing or pulverizing tool into an effective position where the shearing occurs and metal scrap is released, without interference from portions of the shearing or pulverizing tool that may hinder the operator's natural and coordinated use of both the shearing or pulverizing tool and the lifting magnet.

SUMMARY OF THE INVENTION

The embodiments of the invention described herein address the shortcomings of the prior art.

In general terms, the present invention may be described as a shear tool or concrete pulverizer comprising pulverizing jaws, with a magnetic lifting attachment comprising a magnet and a hydraulic actuator adapted to move the magnet between a stored position and an active position with respect to the demolition tool by simultaneous movement of at least one of the jaws.

Demolition and Lifting Boom Arm Attachment

The present invention includes a magnetic lifting attachment to the boom structure and hydraulic system of a demolition machine, the boom structure and hydraulic system of a demolition machine comprising a demolition tool selected from the group consisting of shearing jaws and a concrete pulverizer comprising pulverizing jaws, and a hydraulic actuator adapted to actuate the demolition tool, the magnetic lifting attachment attached to the boom structure and comprising a magnet and a hydraulic actuator adapted to move the magnet between a stored position and an active position with respect to the demolition tool by simultaneous movement of at least one of the jaws.

In a preferred embodiment as applied to a concrete pulverizer tool head, the magnet may be incorporated into a moveable portion of the tool that is stationary when the tool head is being used, such as by incorporating or attaching the magnet to the stationary jaw of a set of pulverizer jaws, such that the stationary jaw is moved from an active position to a stored position while the magnet conversely is moved from a stored position to an active position.

Shearing or Pulverizing Demolition Tool and Lifting Boom Arm for a Demolition Machine The present invention includes a shearing and lifting boom arm for a demolition machine, comprising: (a) an articulating boom arm bearing: (1) a demolition tool selected from the group consisting of (i) shearing jaws and (ii) a concrete pulverizer comprising pulverizing jaws, and a hydraulic actuator adapted to actuate the demolition tool; and (2) a magnetic lifting attachment comprising a magnet and a hydraulic actuator adapted to move the magnet between a stored position and an active position with respect to the demolition tool by simultaneous movement of at least one of the jaws.

The present invention includes a shearing and lifting boom arm that may be used in applications that do not require a vehicle base.

The active position may be any position where the magnet may be operated without interference from the demolition tool, typically and preferably the active position is below the demolition tool, although it might also be positioned beyond or actively astride the demolition tool head.

Likewise, the stored position may be any position where the magnet may be stored so as not to interfere or restrict the operation of the demolition tool, and typically and preferably may be selected from the group consisting of either (1) alongside the articulating arm and (2) above and behind the active position of the demolition tool and beneath the articulating arm.

Shearing or Pulverizing Demolition Tool and Magnetic Lifting Demolition Machine

The present invention also includes a shearing and lifting demolition machine comprising a vehicle base having an articulating arm, the articulating arm bearing: (1) a demolition tool selected from the group consisting of (a) shearing jaws and (b) a concrete pulverizer comprising pulverizing jaws, and a hydraulic actuator adapted to actuate the demolition tool; and (2) a magnetic lifting attachment and a hydraulic actuator adapted to move the magnetic lifting attachment between a stored position and an active position with respect to the demolition tool by simultaneous movement of at least one of the jaws (the stored and active positions as described above).

Method of Heavy Demolition Using Shearing or Pulverizing Demolition Tool and Lifting Boom Arm for a Demolition Machine The present invention further includes a method of heavy demolition, the method comprising the steps: (a) operating a shearing and lifting machine at a site where scrap material is located, the shearing and lifting machine comprising a vehicle base having an articulating arm, the articulating arm bearing: (1) a demolition tool selected from the group consisting of (i) shearing jaws and (ii) a concrete pulverizer comprising pulverizing jaws, and a hydraulic actuator adapted to actuate the demolition tool; and (2) a magnet and a hydraulic actuator adapted to move the magnet between a stored position and an active position with respect to the demolition tool by simultaneous movement of at least one of the jaws; and (b) demolishing the scrap material with the demolition tool so as to obtain sheared scrap material; followed by (c) lifting the sheared scrap material with the magnet.

Typically, the magnet is moved from the active position to the stored position prior to demolishing the scrap material with the demolition tool. The magnet normally is moved from the stored position to the active position prior to lifting of the sheared scrap material with the magnet.

Once lifted, the scrap material may be transported, typically from the demolition site for further processing or transport, by action of the vehicle base.

The method may also include the step of moving the sheared scrap material with the magnet, followed by releasing the sheared scrap material from the magnet, in order to facilitate further processing or transport of the scrap material.

Following use of the magnetic lifter, the method typically will include the step of de-energizing the magnet and moving the magnet from the active position to the stored position following the release of the sheared scrap material from the magnet, to permit further use of the demolition tool.

In a preferred embodiment, the method of the present invention comprises the steps: (a) operating a shearing or pulverizing and lifting machine at a site where scrap material is located, the shearing/pulverizing and lifting machine comprising a vehicle base having an articulating arm, the articulating arm bearing: (1) a demolition tool selected from the group consisting of (i) shearing jaws and (ii) a concrete pulverizer comprising pulverizing jaws, and a hydraulic actuator adapted to actuate the demolition tool; and (2) a magnet and a hydraulic actuator adapted to move the magnet from a stored position to an active position with respect to the demolition tool by simultaneous movement of at least one of the jaws; and (b) demolishing the scrap material with the demolition tool so as to obtain sheared scrap material (or material freed from the concrete); followed by (c) moving the magnet from the stored position to the active position; (d) lifting the sheared/freed scrap material with the magnet; (e) transporting the scrap material lifted by the magnet by action of the vehicle base; and (f) releasing the sheared/freed scrap material from the magnet; and (g) de-energizing the magnet and moving the magnet from the active position to the stored position.

Using the hydraulic controls governing the demolition tool and the magnetic lifter, the operator is able to perform the steps of the method of the present invention without leaving the relative safety of the vehicle cab, and is therefore able to perform demolition much more safely and efficiently.

DETAILED DESCRIPTION OF THE PREFERRED EMBODIMENTS

In accordance with the foregoing summary, the following describes a preferred embodiment of the present invention which is considered to be the best mode thereof. With reference to the drawings, the invention will now be described in detail with regard for the best mode and preferred embodiment.

Figure 1:
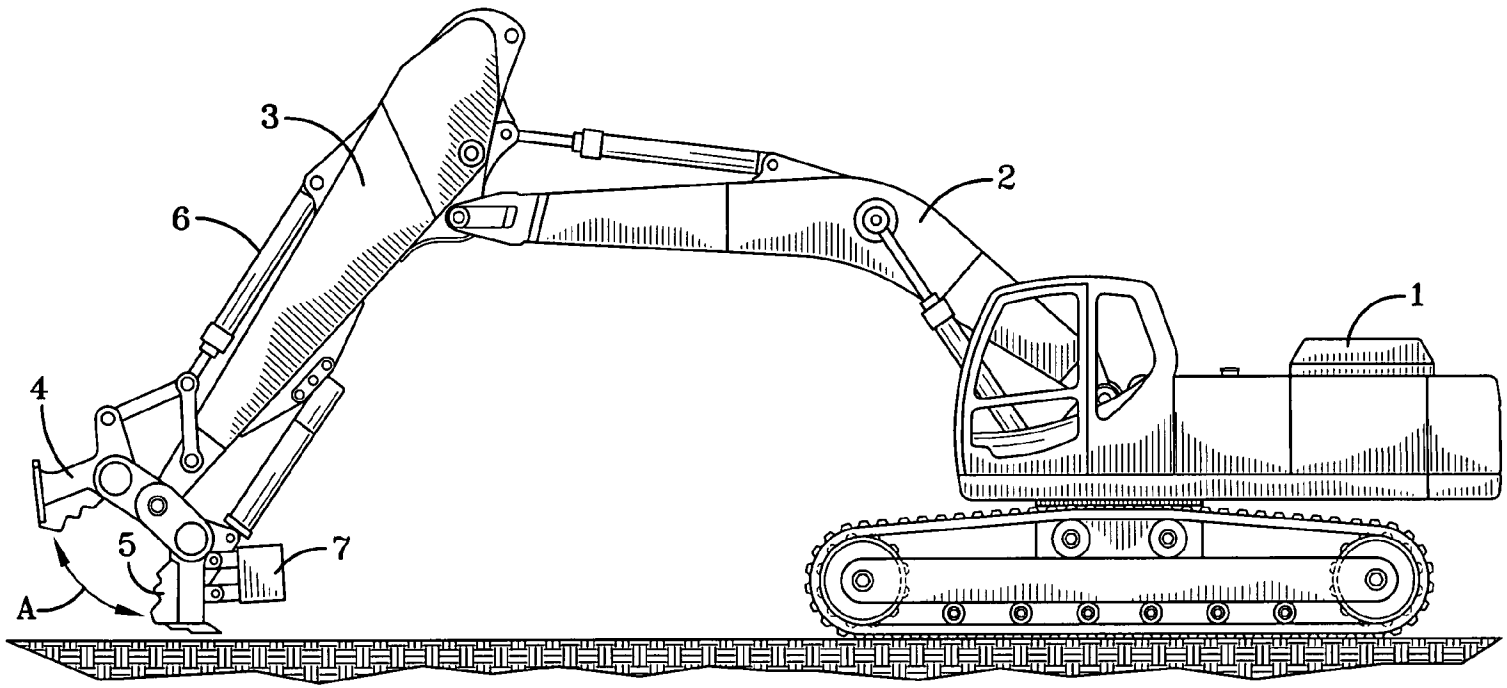
FIG. 1 is a side elevation view of a demolition machine, showing the magnetic lifter in the stored position, which may be adapted as a demolition shear or concrete pulverizer machine apparatus in accordance with one embodiment of the present invention.

FIG. 1 is a side elevation view of a demolition machine, showing the magnetic lifter in the stored position, which may be adapted as a demolition shear or concrete pulverizer machine apparatus in accordance with one embodiment of the present invention. The device of the present invention may be mounted upon and/or adapted to commercial demolition equipment known and used in the art, such as those commercially available from Kubota of Osaka, Japan (also Kubota Manufacturing of America of Gainesville, Ga., U.S.A.) or Case Construction Equipment, Inc. of Racine, Wis., USA.

FIG. 1 shows smaller machine tractor carrier vehicle 1 bearing machine boom 2 bearing the machine arm 3 that may bear a shearing head or a concrete pulverizing demolition tool, in this case a pulverizing demolition tool head having a moving jaw 4 and a stationary jaw 5, moving jaw 4 being actuated by hydraulic actuator 6, so as to move along direction line A. This may be done through the use of hydraulic actuators and their control systems known and used in the art.

The shearing heading or concrete pulverizing demolition tool that may be used in accordance with the present invention may be those commercially available from The Stanley/LaBounty Company of Two Harbors, Minn., and such as those described in U.S. Pat. Nos. RE35,432; 7,354,010; 7,311,126; 7,306,177; 7,284,720; 7,284,718; 7,284,330; 7,255,295; 7,216,575; 7,121,489; 7,108,211; 6,994,284; 6,926,217; 6,839,969; 6,119,970; 6,061,911; and 5,894,666, all of which are hereby incorporated herein by reference. Additional concrete pulverizing demolition tools are described in U.S. Pat. Nos. 5,704,560; 6,129,298; 6,439,317; and 7,407,017, also hereby incorporated herein by reference.

Figure 2:
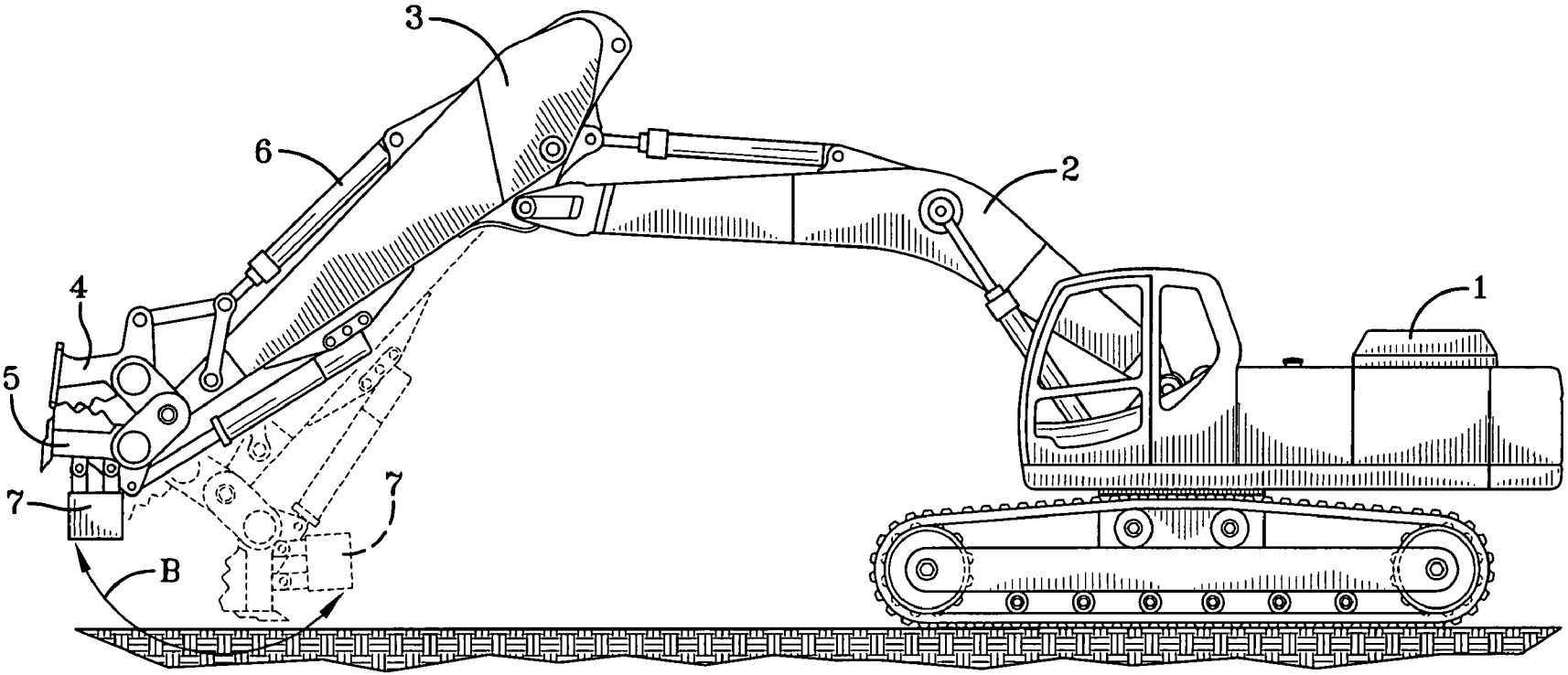
FIG. 2 is a side elevation view of a demolition machine, showing the magnetic lifter in the active position, which may be adapted as a demolition shear or concrete pulverizer machine apparatus in accordance with one embodiment of the present invention.

FIG. 1 shows the magnetic lifter 7 in the stored position, the magnetic lifter 7 being moveably linked, in this embodiment, to the stationary jaw 5, so as to be moveable between its stored position and its active position, as shown in FIG. 2, so as to move along direction line B. It will be understood that the displayed embodiment allows for the movement of the stationary jaw 5 from its active position (i.e., coincidentally, the magnetic lifter's stored position) to its own stored position as shown in FIG. 2.

FIG. 2 shows the magnetic lifter 7 in the active position, having been moved along direction line B. In this embodiment, it will be appreciated that the magnet is moved into an effective position where the shearing occurs and metal scrap is released, without interference from portions of the shearing or pulverizing tool that may hinder the operator's natural and coordinated use of both the shearing or pulverizing tool and the lifting magnet. This allows the operator to more efficiently shear/pulverize scrap material and then readily place the magnet for lifting without having to reposition the boom or arm in order to deploy the magnet into a position to pick and lift the newly cut or pulverized material.

However, it will be understood that, in other embodiments, the magnetic lifter may be reversibly moved between its stored position to its active position with simultaneous movement of any other potential obstructive or interference structure, depending upon the particular design and layout of the demolition tool. For instance, a demolition machine may be provided with a shearing head that has no discrete active and stored positions, and wherein the magnetic lifter is deployed by moving the entire shearing head upward or to one side.

In the preferred embodiment, the present invention may be reversibly moved between its stored position clear of the shearing head to its active position below or in front of the shearing head.

For instance, the present invention may be used with or adapted from shearing tool heads commercially available from the Stanley/LaBounty Company of Two Harbors, Minn., and may be used in the hybrid and retrofit machine applications of the present invention.

For instance, for bucket linkage shears, the tractor vehicle ("excavator") weight and corresponding attachment weight are normally as follows:

| | (1) EXCAVATOR WEIGHT APPROXIMATE 3rd Member | | (2) ATTACHMENT WEIGHT APPROXIMATE | | (3) JAW OPENING | | JAW DEPTH | |
|---|---|---|---|---|---|---|---|---|
| MODEL | (lbs) | (m tons) | (lbs) | (kg) | (in) | (mm) | (in) | (mm) |
| BLS 40 | 40,000-65,000 | 18-30 | 2,900 | 1,315 | 15-18 | 381-457 | 18 | 457 |
| BLS 80 | 70,000-100,000 | 32-45 | 3,500 | 1,588 | 17-20 | 432-508 | 19.5 | 495 |

In a preferred embodiment, the demolition tool of the present invention may be placed upon a relatively lighter shearing demolition machine having a weight less than or equal to about 65,000 pounds with a shearing head that is capable of being attached to a relatively heavier shearing demolition machine having a weight greater than 65,000 pounds (i.e., replacing a shearing head weighing less than about 3,000 pounds with a reconfigured shearing head weighing more than about 3,000 pounds), a demolition machine better suited for more efficient demolition clean-up operations may be achieved with no diminishment in shearing performance.

The relatively larger shearing head is reconfigured so as to be able to be borne by and be operative upon the relatively smaller machine boom, as shown in FIG. 1. This may be done by connecting the relatively larger shearing head with due regard to the balance and articulation required of the relatively smaller machine tractor vehicle 1 and relatively smaller machine boom 2 in combination to be able to accommodate the movement of the reconfigured relatively larger machine arm 3, as well as with due regard to the placement and geometrical arrangement of the associated hydraulic actuators.

The present invention may be used with or adapted from known concrete pulverizers, and these tool heads may be commercially available from the Stanley/LaBounty Company of Two Harbors, Minn., and may be used in the hybrid and retrofit machine applications of the present invention. For concrete pulverizers, the tractor vehicle ("excavator") weight and corresponding attachment weight are normally as follows:

| MODEL | # OF TEETH UPPER/ LOWER | (1) EXCAVATOR WEIGHT (APPROX.) (lbs.) | (M Tons) | (2) ATTACHMENT WEIGHT (APPROX.) (lbs.) | (Kg) | (3) JAW OPENING (TIP TO TIP) (APPROX.) (in) | (mm) | (4) STANDARD BACK JAW WIDTH (in) | (mm) | STANDARD JAW DEPTH (TIP TO THROAT) (in) | (mm) |
|---|---|---|---|---|---|---|---|---|---|---|---|
| CP 40 | 3/4 | 36-46,000 | 16-21 | 2,875 | 1,304 | 30 | 762 | 26 | 660 | 25 | 635 |
| CP 60 | 3/4 | 46-65,000 | 21-29 | 3,000 | 1,361 | 36 | 914 | 29 | 737 | 27 | 686 |
| CP 80 | 3/4 | 65-88,000 | 29-40 | 4,475 | 2,030 | 42 | 1,067 | 32.5 | 826 | 29 | 736 |
| CP 100 | 3/4 | 88-111,000 | 40-50 | 6,150 | 2,790 | 48 | 1,219 | 33 | 838 | 35 | 889 |
| CP 120 | 4/5 | 111-160,000 | 50-73 | 9,900 | 4,491 | 54 | 1,372 | 43.5 | 1,105 | 40 | 1,016 |

The preferred embodiment includes retrofitting a relatively lighter pulverizing demolition machine having a weight less than or equal to 65,000 pounds with a pulverizing head that is adapted to be attached to a relatively heavier pulverizing demolition machine having a weight greater than 65,000 pounds (preferably by replacing a pulverizing head weighing less than or equal to about 3,000 pounds with a pulverizing head weighing more than about 4,000 pounds (as may be selected from the above table). Preferred vehicle and tool weights are additionally described in U.S. Provisional Patent Application Ser. No. 61/397,599 which is hereby incorporated herein by reference.

The weight of the relatively lighter vehicles has been found to be sufficient to support the magnetic lifting of scrap material subject to shearing or resulting from pulverization.

In a preferred embodiment, the operation of the machine of the present invention typically involves shearing or pulverizing the scrap material at a site where scrap material is located to obtain sheared/freed scrap material, followed by moving the magnet from the stored position to the active position and lifting the sheared/freed scrap material with the magnet. The scrap material is then lifted by the magnet by action of the vehicle base and boom arm, and released from the magnet once moved to the desired position for further transport or processing. Thereafter, the magnet may be de-energized, and moved from the active position to the stored position.

In operation, the demolition machines of the present invention may be used in the conventional manner, but allows the operator to readily change the operation mode of the demolition machine from shearing or pulverizing to picking and removal, in order to demolish and remove scrap material without having to attach or reconfigure a magnet in a separate operation, and without leaving the cab of the vehicle.

In addition, the preferred hybrid weight machines have been found to offer the ideal combination of cutting force and nimble navigation within the demolition site environment, to best navigate through paths of rubble and with increased visibility toward demolished material scrap and workers on site. The combination of the invention also allows scrap material to be efficiently moved off the demolition site for transport and recycling.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

What is claimed is:

1. A demolition tool and lifting boom arm for a demolition machine, comprising:

a. an articulating boom arm bearing:

(1) a demolition tool selected from the group consisting of (a) shearing jaws and (b) a concrete pulverizer comprising pulverizing jaws, and a hydraulic actuator adapted to actuate said demolition tool; and (2) a magnetic lifting attachment comprising a magnet and a hydraulic actuator adapted to move said magnet between a stored position and an active position with respect to said demolition tool by simultaneous movement of at least one of said jaws.

2. A demolition tool and lifting boom arm according to claim 1 wherein said demolition tool comprises shearing jaws.

3. A demolition tool and lifting boom arm according to claim 1 wherein said demolition tool comprises a concrete pulverizer having a first and second jaw portion.

4. A demolition tool and lifting boom arm according to claim 1 wherein said active position is below said demolition tool.

5. A demolition tool and lifting boom arm according to claim 1, wherein said stored position is selected from the group consisting of (1) alongside said articulating arm and (3) above and behind said demolition tool and beneath said articulating arm.

6. A demolition machine comprising a vehicle base having an articulating arm, said articulating arm bearing: (1) a demolition tool selected from the group consisting of (a) shearing jaws and (b) a concrete pulverizer comprising pulverizing jaws, and a hydraulic actuator adapted to actuate said demolition tool; and (2) a magnetic lifting attachment and a hydraulic actuator adapted to move said magnetic lifting attachment between a stored position and an active position with respect to said demolition tool by simultaneous movement of at least one of said jaws.

7. A demolition machine according to claim 6 wherein said active position is below said jaws.

8. A demolition machine according to claim 6, wherein said stored position is selected from the group consisting of (1) alongside said articulating arm and (2) above and behind said demolition tool and beneath said articulating arm.

9. A demolition machine according to claim 6, wherein said vehicle base has a weight less than or equal to about 65,000 pounds and a demolition tool weighing more than about 4,000 pounds.

10. A method of heavy demolition, said method comprising the steps:

a. operating a shearing and lifting machine at a site where scrap material is located, said shearing and lifting machine comprising a vehicle base having an articulat ing arm, said articulating arm bearing: (1) a demolition tool selected from the group consisting of (a) shearing jaws and (b) a concrete pulverizer comprising pulverizing jaws, and a hydraulic actuator adapted to actuate said demolition tool; and (2) a magnet and a hydraulic actuator adapted to move said magnet between a stored position and an active position with respect to said demolition tool by simultaneous movement of at least one of said jaws; and b. demolishing said scrap material with said demolition tool so as to obtain sheared scrap material; followed by c. moving said magnet between a stored position and an active position with respect to said demolition tool by simultaneous movement of at least one of said jaws; and d. lifting said sheared scrap material with said magnet.

11. A method of heavy demolition according to claim 10, additionally comprising the step of transporting said scrap material lifted by said magnet by action of said vehicle base.

12. A method of heavy demolition according to claim 11, additionally comprising the step of moving said sheared scrap material with said magnet, followed by releasing said sheared scrap material from said magnet.

13. A method of heavy demolition according to claim 12, additionally comprising the step of deenergizing said magnet and moving said magnet from said active position to said stored position following the release of said sheared scrap material from said magnet.

14. A method of heavy demolition, said method comprising the steps:

a. operating a shearing and lifting machine at a site where scrap material is located, said shearing and lifting machine comprising a vehicle base having an articulating arm, said articulating arm bearing: (1) a demolition tool selected from the group consisting of (a) shearing jaws and (b) a concrete pulverizer comprising pulverizing jaws, and a hydraulic actuator adapted to actuate said demolition tool; and (2) a magnet and a hydraulic actuator adapted to move said magnet from a stored position to an active position with respect to said demolition tool by simultaneous movement of at least one of said jaws; and b. demolishing said scrap material with said demolition tool so as to obtain sheared scrap material; followed by c. moving said magnet from said stored position to said active position by simultaneous movement of at least one of said jaws;

d. lifting said sheared scrap material with said magnet;

e. transporting said scrap material lifted by said magnet by action of said vehicle base; and f. releasing said sheared scrap material from said magnet; and g. deenergizing said magnet and moving said magnet from said active position to said stored position.

* * * * *